US006269332B1

(12) United States Patent
Choo et al.

(10) Patent No.: US 6,269,332 B1
(45) Date of Patent: Jul. 31, 2001

(54) METHOD OF ENCODING A SPEECH SIGNAL

(75) Inventors: Wee Boon Choo; Soo Ngee Koh, both of Singapore (SG)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/319,103

(22) PCT Filed: Sep. 30, 1997

(86) PCT No.: PCT/SG97/00050

§ 371 Date: May 28, 1999

§ 102(e) Date: May 28, 1999

(87) PCT Pub. No.: WO99/17279

PCT Pub. Date: Apr. 8, 1999

(51) Int. Cl.[7] ..... G10L 11/06

(52) U.S. Cl. ..... 704/233; 704/203; 704/207; 704/208

(58) Field of Search ..... 704/203, 204, 704/207, 208, 219, 220, 222, 223, 224, 229

(56) References Cited

U.S. PATENT DOCUMENTS

| | | | | |
|---|---|---|---|---|
| 5,150,410 | | 9/1992 | Bertrand | 380/28 |
| 5,473,727 | | 12/1995 | Nishiguchi et al. | 395/2.31 |
| 5,701,390 | | 12/1997 | Griffin et al. | 395/2.15 |
| 5,765,126 | * | 6/1998 | Tsutsui et al. | 704/206 |
| 5,832,424 | * | 11/1998 | Tsutsui | 704/206 |
| 6,131,084 | * | 10/2000 | Hardwick | 704/230 |
| 6,144,937 | * | 11/2000 | Ali . | |

OTHER PUBLICATIONS

Lupini et al. vector quantization of harmonic magnitudes for low–rate speech coder, 1994.*

Lupini P. and Cuperman V., "Nonsquare Transform Vector Quantization," IEEE Signal Processing Letters, vol. 3, No. 1, Jan. 1996, pp. 1–3.

Cuperman V., Lupini P., and Bhattacharya B., "Spectral Excitation Coding of Speech at 2.4 kbps," Proceedings, IEEE International Conference on Acoustics, Speech and Signal Processing, vol. 1, 1995, pp. 496–499.

Lupini P. and Cuperman V., "Vector Quantization of Harmonic Magnitudes for Low–Rate Speech Coders," Proceedings, IEEE Globecom, vol. 2, NY, USA, 1994, pp 858–862.

(List continued on next page.)

*Primary Examiner*—William Korzuch
*Assistant Examiner*—Daniel Abebe
(74) *Attorney, Agent, or Firm*—Senniger, Powers, Leavitt & Roedel

(57) ABSTRACT

A method of coding speech is disclosed in which the speech signal is sampled and divided into a plurality of frames upon which multi-band excitation analysis is performed to derive a fundamental pitch, a plurality of voiced/unvoiced decisions and amplitudes of harmonics within the bands. The harmonic amplitudes are split into a first group of a fixed number of harmonics and a second group of the remainder of harmonics and these are separately transformed using the Discrete Cosine Transform for the first group and Non-Square Transform for the second group, the resulting transform coefficients being vector quantized to form a plurality of output indices. A decoding method and apparatus for performing both encoding and decoding methods are also disclosed.

22 Claims, 2 Drawing Sheets

OTHER PUBLICATIONS

Figure 1:
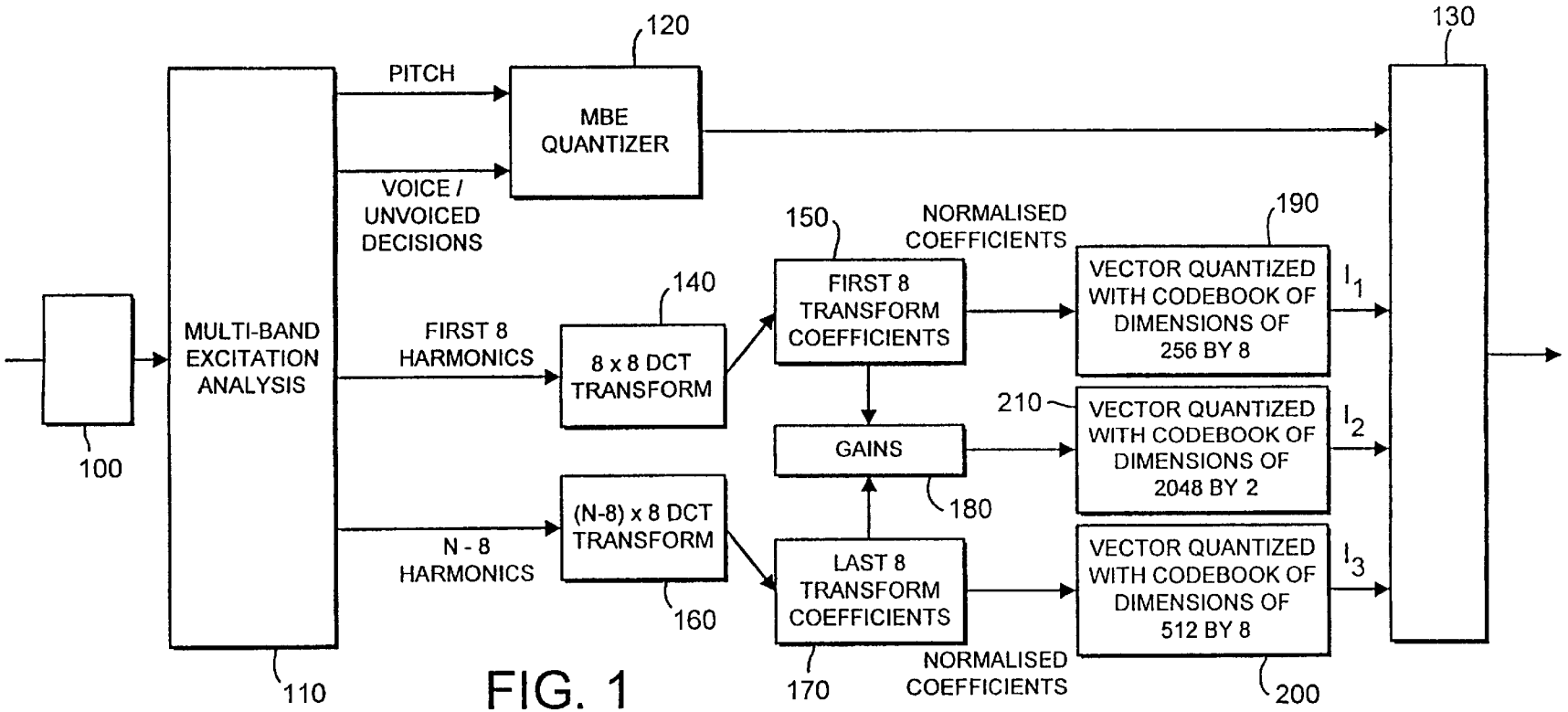

Griffin D. W. and Lim J. S. "Multiband Excitation Vocoder," IEEE on Acoustics, Speech and Signal Processing, vol. 36, No. 8, 1988 pp. 1223–1235.

Hardwick J. C. and Lim J. S., "A 4.8 kbps Multiband Excitation Speech Coder," Proceedings, IEEE International Conference on Acoustics, Speech and signal Processing, 1988, pp. 374–377, Dao A and Gersho A., "Enhanced Multiband Excitation Coding of Speech at 2.4 kbps with Phonetic Classification and Variable Dimension VQ," Signal Processing VII: Theories and Applications, 1994, pp. 943–946.

Digital Voice Systems Inc., Inmarsat–M Voice Codec, Version 3.0, Aug. 1991.

* cited by examiner

METHOD OF ENCODING A SPEECH SIGNAL

This invention relates to a method of and apparatus for encoding a speech signal, more particularly, but not exclusively, for encoding speech for low bit rate transmission and storage.

BACKGROUND OF THE INVENTION

In many audio applications it is desired to transfer or store digitally an audio signal for example a speech signal. Rather than attempting to sample and subsequently reproduce a speech signal directly, a vocoder is often employed which constructs a synthetic speech signal containing the key features of the audio signal, the synthetic signal being then decoded for reproduction.

A coding algorithm that has been proposed for use with a vocoder user a speech model called the Multi-Band Excitation (MBE) model, first proposed in the paper "Multi-Band Excitation Vocoder" by Griffin and Lim, IEEE Transactions on Acoustics, Speech and Signal Processing Volume 36 No. 8 August 1988 Page 1223. The MBE model divides the speech signal into a plurality of frames which are analyzed independently to produce a set of parameters modelling the speech signal at that frame, the parameters being subsequently encoded for transmission/storage. The speech signal in each frame is divided into a number of frequency bands and for each frequency band a decision is made whether that portion of the spectrum is voiced or unvoiced and then represented by either periodic energy, for a voiced decision or noise-like energy for an unvoiced decision. The speech signal in each frame is characterised, using the model, by information comprising the fundamental frequency of the speech signal in the frame, voiced/unvoiced decisions for the frequency bands and the corresponding amplitudes for the harmonics in each band. This information is then transformed and vector quantized to provide the encoder output. The output is decoded by reversing this procedure. A proposal for implementation of a vocoder using the multi-band excitation model may be found in the Inmarsat-M Voice Codec, Version 3, August 1991 SDM/M Mod. 1/Appendix 1 (Digital Voice System Inc.).

It is a problem for implementation of such a vocoder that the fundamental pitch period and the number of harmonics changes from frame to frame, since these features are functions of the talker. For example, male speech generally has a lower fundamental frequency, with more harmonic components whereas female speech has a higher fundamental frequency with fewer harmonics. This causes a variable-dimension vector quantization problem. One proposed solution to the problem is to truncate the speech signal by selecting only a predetermined number of harmonics. However, such an approach causes unacceptable speech degradation particularly when recognition of the speaker of the reconstructed speech signal is desired.

A proposal to alleviate this problem is the use of Non-Square Transform (NST) vector-quantization as proposed by Lupini and Cuperman in IEEE Signal Processing Letters, Volume 3, No. 1, January 1996 and Cuperman, Lupini and Bhattacharya in the paper "Spectral Excitation Coding of Speech at 2.4 kb/s" Proceedings, IEEE International Conference on Acoustics, Speech and Signal Processing Volume 1. With this approach, the NST transforms the varying number of spectral harmonic amplitudes to a fixed number of transform coefficients which are then vector-quantized.

It is a disadvantage of this proposal, however, that very high computational complexity is involved in the Non-Square Transform operation. This is because the transformation of the varying-dimension vectors into either fixed 30 or 40 dimension vectors of this proposal is highly computationally intensive and requires a large memory to store all the elements of the transform matrices. The recommended fixed dimensional vector requires a one stage quantization which is also computationally expensive. It is a further disadvantage of NST vector quantization that the technique introduces distortion in the speech signal which degrades the perceptual quality of reproduced speech when the size of the codebook of the vector quantizers is small.

In some applications it is desired to encode the speech at a low bit rate, for example 2.4 kbps or less. A speech signal encoded in this way requires less memory to store the signal digitally, thus keeping the cost of a device using the bit rate. However, the use of NST vector quantization with the consequent requirements of high computational power and memory together with the problem of distortion does not provide a feasible solution to the problem of low cost encoding and storage of speech at such low bit rates.

It is the object of the invention to provide a method of an apparatus for speech coding which alleviates at least one of the disadvantages of the prior art.

SUMMARY OF THE INVENTION

According to the invention in the first aspect, there is provided a method of encoding a speech signal comprising the steps of:

sampling the speech signal;

dividing the sample speech signal into a plurality of frames;

performing multi-band excitation analysis on the signal within each frame to derive a fundamental pitch, a plurality of voiced/unvoiced decisions for frequency bands in the signal and amplitudes of harmonics within said bands;

transforming the harmonic amplitudes to form a plurality of transform coefficients;

vector quantizing the coefficients to form a plurality of indices; characterised by dividing the harmonic amplitudes into a first group of a fixed number of harmonics and a second group of the remainder of the harmonics, the first and second groups being subject to different transforms to form respective first and second sets of transform coefficients for quantization.

Preferably the first transform is a Discrete Cosine Transform (DCT) which transforms the first predetermined number of harmonics into the same number of first transform coefficients. The second transform is preferably a Non-Square Transform (NST), transforming the remainder of the harmonics into a fixed number of second transform coefficients.

Most preferably, the first group comprises the first 8 harmonics of the audio signal which are transformed into 8 transform coefficients and the second group comprising the remainder of the harmonics which are also transformed into 8 transform coefficients.

With the method of the invention, the first group of harmonics is selected to be the most important harmonics for the purpose of recognising the reconstructed speech signal. Since the number of such harmonics is fixed, it is possible to use a fixed dimension transform such as the DCT thus minimising distortion and keeping the dimension of the most important parameters unchanged. On the other hand, the remaining less important harmonics are transformed using the NST variable dimension transform. Since only the less significant harmonics are transformed using the NST, the effect of distortion on reproducibility of the audio signal is minimised.

Furthermore, since the harmonics are split into two groups, the degree of computational power necessary to transform and encode the consequently smaller vectors is less, thus reducing the computational power needed for the encoder.

According to the invention in a second aspect, there is provided a method of decoding an input data signal for speech synthesis comprising the steps of:

vector dequantizing a plurality of indices of the data signal to form first and second sets of transform coefficients;

transforming the first and second sets of coefficients to derive respective first and second groups of harmonic amplitudes;

deriving pitch and voiced/unvoiced decision information from the input data signal;

performing multi-band excitation analysis on the information and the harmonic amplitudes to form a synthesized signal; and constructing a speech signal from the synthesized signal.

According to the invention in a third aspect, there is provided speech coding apparatus comprising:

means for sampling a speech signal and dividing the sampled signal into a plurality of frames;

a multi-band excitation analyzer for deriving a fundamental pitch and a plurality of voiced / unvoiced decisions for frequency bands in each frame and amplitudes of harmonics within said bands;

transform means for transforming the harmonic amplitudes to form a plurality of transform coefficients;

vector quantization means for quantizing the coefficients to form a plurality of indices;

characterised in that the transform means comprises first transform means for transforming a first fixed number of harmonics into a first set of transform coefficients and second transform means for transforming the remainder of the harmonic amplitudes into a second set of transform coefficients.

According to the invention in a fourth aspect, there is provided decoding apparatus for decoding an input data signal for speech synthesis comprising vector dequantization means for dequantizing a plurality of indices to form at least two sets of transform coefficients, first and second transform means for inverse-transforming respectively the first and second sets of coefficients to derive first and second groups of harmonic amplitudes, a multi-band excitation synthesizer for combining the harmonics with pitch and voiced/unvoiced decision information from the input signal and means for constructing a speech signal from the output of the synthesizer.

Figure 2:
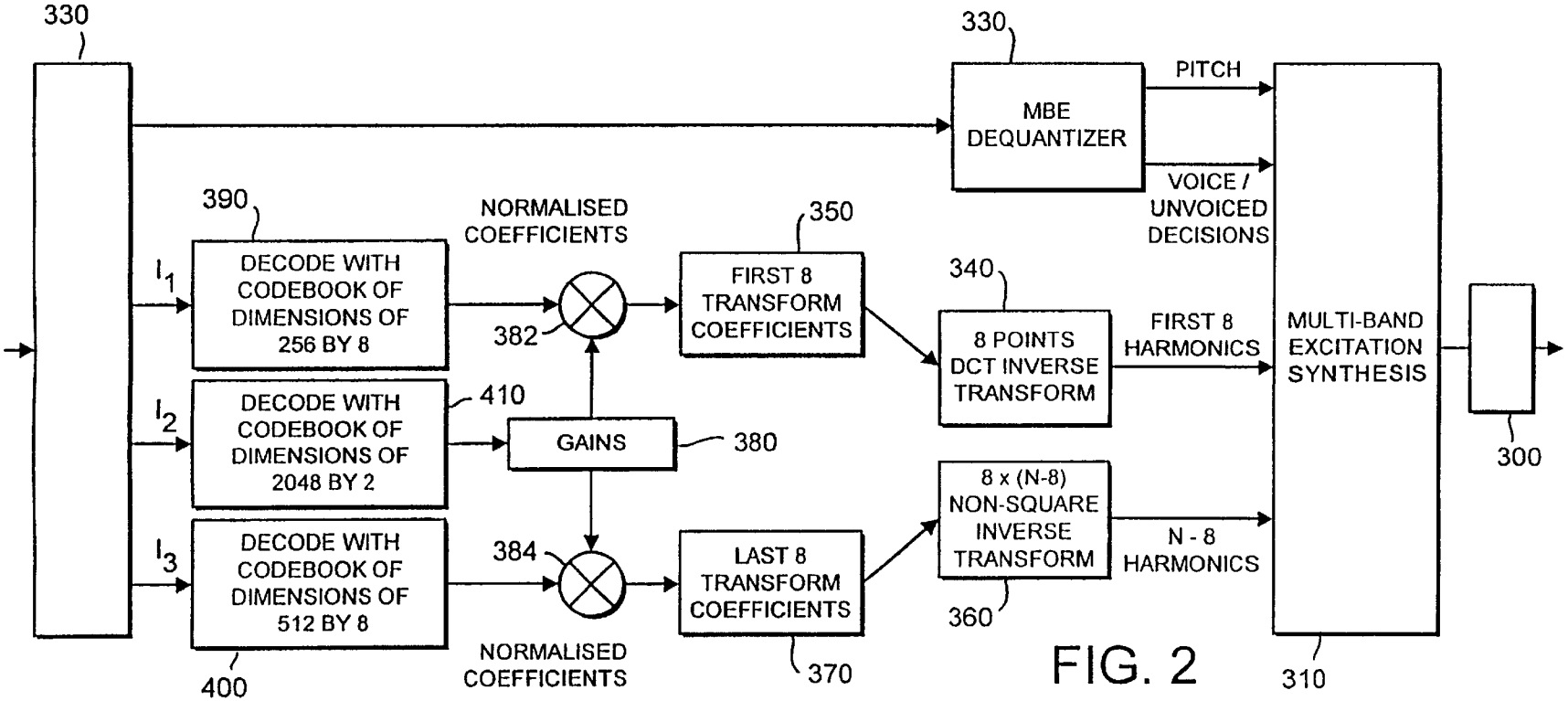

An embodiment of the invention will now be described, by way of example, with reference to the accompanying drawings in each:

1. FIG. 1 is a block diagram of an embodiment of encoding apparatus of the invention;

2. FIG. 2 is a block diagram of an embodiment of decoding apparatus of the invention for decoding speech encoded using the embodiment of FIG. 1.

DETAILED DESCRIPTION OF THE PREFERRED EMBODIMENT

With reference to FIG. 1, an embodiment of encoding apparatus in accordance with the invention is shown.

The embodiment is based on a Multi-Band Excitation (MBE) speech encoder in which an input speech signal is sampled and analog to digital (A/D) converted at block 100. The samples are then analyzed using the MBE model at block 110. The MBE analysis groups the samples into frames of 160 samples, performs a discrete Fourier transform on each frame, derives the fundamental pitch of the frame and splits the frame harmonics into bands, making voiced/unvoiced decisions for each band. This information is then quantized using a conventional MBE quantizer 120 (the pitch information being scalar quantized into 8 bits and the voice/unvoiced decision being requested by one bit) and combined with vector quantized harmonics as described below at block 130 to form a digital representation of each frame for transmission or storage.

The MBE analysis at step 110 further provides an output of harmonic amplitudes, one for each harmonic in the frame of the speech signal. The number N of harmonic amplitudes varies in dependence upon the speech signal in the frame and are split into two groups, a fixed size group of the first 8 harmonics which are generally the most significant harmonics of the frame and a variable sized group of the remainder. The first 8 harmonics are subject at block 130 to a Discrete Cosine Transformation (DCT) to form a first shape vector comprising 8 first transform coefficients at block 150. The reminding N-8 harmonics are subject at block 160 to a Non-Square Transformation (NST) to form 8 last transform coefficients at block 170. The first 8 harmonics which are generally the most significant harmonics being DCT transformed are transformed accurately. The remaining harmonics are transformed with less accuracy using the NST but since these are less important, the quality of the decoded speech is not sacrificed significantly despite the reduction in computational requirements.

The transform coefficients formed at blocks 150,170 are then normalised each to provide a gain value and 8 normalised coefficients. The gain values are combined into a single gain vector at block 180 (the gain values for the first and last transform coefficients remaining independent in the gain vector) and the normalised coefficients and the gain vectors are then quantized in vector quantizers 190, 200, 210 in accordance with individual vector codebooks.

As shown, the codebook for the first 8 transform coefficients is of dimension 256 by 8, for the last transform coefficients of dimension 512 by 8 and for the gain values, of dimension 2048 by 2. The size of the codebooks can be changed in dependence upon the degree of approximation of the encoded information required—the larger the codebook, the more accurate the quantization process at the expense of greater computational power and memory.

The output from the quantizers 190–210 are three codebook indices I1–I3 which are combined at block 130 with the quantized pitch and V/UV information to produce a digital data signal for each frame. The combination process at block 130 maintains each element discrete in a predetermined order to allow decoding as described below.

With reference to FIG. 2, a decoder for decoding the output signal of FIG. 1 is shown, which performs the inverse operation of the encoder of FIG. 1 and for which blocks having like, inverse functions have been represented by like reference numerals with the addition of 200.

At block 330 the data signal is split into its component parts, indexes I1–I3 and the quantized pitch and V/UV decision information. The three codebook indices I1–I3 are decoded by extracting the correct entries from the respective codebooks in block 390, 400, 410. The gain information is then extracted for each set of transform coefficients at block 380 and multiplied with the output normalised coefficients at 382, 384 to form the first and last 8 transform coefficients at blocks 350, 370. The two groups of transform coefficients are inverse transformed at blocks 340, 360 and output to a Multi-Band Excitation synthesizer 310 along with the pitch and V/UV decision information extracted from a MBE dequantizer 330 which decodes the 8 bit data using a decoding table.

The MBE synthesizer 310 then performs the reverse operation to analyzer 110, assembling the signal components, performing an inverse discrete Fourier transform for unvoiced bands, performing voiced speech synthesis by using the decoded harmonic amplitudes to control a set of sinusoidal oscillators for the voiced bands, combining the synthesised voiced and unvoiced signals in each frame and connecting the frames to form a signal output. The signal output from the synthesizer 310 is then passed through a digital to analog converter at block 300 to form an audio signal.

The embodiment of the invention has particular application in devices in which it desired to store an audio signal in digital form, for example in a digital answering machine or digital dictating machine. The embodiment of the invention is particularly applicable for a digital answering machine since it is desired that the talker can be recognised but at the same time, as a relatively inexpensive domestic appliance, there is a requirement to keep the digital encoding computational and memory requirements down. Using the embodiment of the invention, it is possible to store the digital information at the bit rate of 2.4 kbps thus requiring a relatively low storage capacity than, for example, other techniques for achieving high quality speech, for example using Code Excited Linear Prediction which requires 16 kbps for toll speech quality, while maintaining recognisable reproduction.

The embodiment described is not to be construed as limitative. For example, although the first 8 harmonics of the signal are chosen as the first group of harmonics on which the fixed dimension transform is formed, other numbers of harmonics could be chosen in dependence upon requirements. Furthermore, although the Discrete Cosine Transform and Non-Square Transform are preferred for transformation of the two groups, other transforms such as wavelet and integer transforms or techniques may be used. The size of vector quantization codebooks can be varied in dependence upon the accuracy of quantization required.

What is claimed is:

1. A method of encoding a speech signal comprising the steps of:

sampling the speech signal;

dividing the sample speech signal into a plurality of frames;

performing multi-band excitation analysis on the signal within each frame to derive a fundamental pitch, a plurality of voiced/unvoiced decisions for frequency bands in the signal and amplitudes of harmonics within said bands;

transforming the harmonic amplitudes to form a plurality of transform coefficients;

vector quantizing the coefficients to form a plurality of indices; characterised by dividing the harmonic amplitudes into a first group of a fixed number of harmonics and a second group of the remainder of the harmonics, the first and second groups being subject to different transforms to form respective first and second sets of transform coefficients for quantization.

2. A method as claimed in claim 1 wherein the first group is transformed using a Discrete Cosine Transform.

3. A method as claimed in claim 1 wherein the second group is transformed using a Non-Square Transform.

4. A method as claimed in claim 1 wherein the second group of harmonics is transformed into the same number of transform coefficients as the first group.

5. A method as claimed in claim 1 wherein the first group comprises the first eight harmonics of signal within each frame.

6. A method as claimed in claim 1 wherein the transform coefficients are normalised to form normalised coefficients and a gain value, the gain values being quantized separately from the sets of normalised coefficients.

7. A method of decoding a signal encoded by the method of claim 1 comprising the steps of dequantizing the indices, inverse transforming the transform coefficients to form the harmonic amplitudes and combining the harmonic amplitudes, fundamental pitch and voiced/unvoiced decisions for Multi-Band Excitation synthesis to construct a speech signal.

8. A method of decoding an input data signal for speech synthesis comprising the steps of:

vector dequantizing a plurality of indices of the data signal to form first and second sets of transform coefficients;

inverse-transforming the first and second sets of coefficients using different transforms to derive respective first and second groups of harmonic amplitudes;

deriving pitch and voiced/unvoiced decision information from the input data signal;

performing multi-band excitation synthesis on the information and the harmonic amplitudes to form a synthesized speech signal; and constructing a speech signal from the synthesized signal.

9. Speech coding apparatus comprising:

means for sampling a speech signal and dividing the sampled signal into a plurality of frames;

a multi-band excitation analyzer for deriving a fundamental pitch and a plurality of voiced/unvoiced decisions for frequency bands in each frame and amplitudes of harmonics within said bands;

transformation means for transforming the harmonic amplitudes to form a plurality of transform coefficients;

vector quantization means for quantizing the coefficients to form a plurality of indices;

characterized in that the transformation means comprises first transform means for transforming a first fixed number of harmonics into a first set of transform coefficients and second transform means for transforming the remainder of the harmonic amplitudes into a second set of transform coefficients, the first and second transform means performing different transforms.

10. Apparatus as claimed in claim 9 wherein the first transform means performs a Discrete Cosine Transform.

11. Apparatus as claimed in claim 9 wherein the second transformation means performs a Non-Square Transform.

12. Apparatus as claimed in claim 9 wherein the first transform means performs the transformation on the first eight harmonics of the frame.

13. Apparatus as claimed in claim 9 wherein the second transformation means transforms the remainder of the harmonics into a second set of transform coefficients of the same number as the set of first transform coefficients.

14. Apparatus as claimed in claim 9 wherein the vector quantization means includes codebooks corresponding to each set of transform coefficients.

15. Apparatus as claimed in claim 9 further comprising means for splitting the sets of transform coefficients into sets of normalised coefficients and respective gain values.

16. Apparatus as claimed in claim 15 wherein the vector quantization means includes a separate codebook for the gain values.

17. Apparatus for storing and reproduction of speech including apparatus as claimed in claim 9.

18. A telephone answering machine including apparatus as claimed in claim 9.

19. Apparatus as claimed in claim 9 in combination with a decoding apparatus for decoding an input data signal for speech synthesis, said decoding apparatus comprising vector dequantization means for dequantizing a plurality of indices to form at least two sets of transform coefficients, first and second transform means for transforming respectively the first and second sets of coefficients using different transforms to derive first and second groups of harmonic amplitudes, a multi-band excitation synthesizer for combining the harmonics with pitch and voiced/unvoiced decision information from the input signal and means for constructing a speech signal from the output of the synthesizer.

20. Decoding apparatus for decoding an input data signal for speech synthesis comprising:

vector dequantization means for dequantizing a plurality of indices to form at least two sets of transform coefficients;

first and second transform means for transforming respectively the first and second sets of coefficients to derive first and second groups of harmonic amplitudes, the first and second transform means performing different transforms;

a multi-band excitation synthesizer for combining the harmonics with pitch and voiced/unvoiced decision information from the input signal; and means for constructing a speech signal from the output of the synthesizer.

21. Apparatus for storing and reproduction of speech including apparatus as claimed in claims 20.

22. A telephone answering maching including apparatus as claimed in claim 20.

* * * * *